US008333243B2

(12) United States Patent
Pallini, Jr. et al.

(10) Patent No.: US 8,333,243 B2
(45) Date of Patent: Dec. 18, 2012

(54) TENSIONER ANTI-ROTATION DEVICE

(75) Inventors: Joseph W. Pallini, Jr., Tombali, TX (US); Fife B. Ellis, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 791 days.

(21) Appl. No.: 12/270,603

(22) Filed: Nov. 13, 2008

(65) Prior Publication Data

US 2009/0145611 A1 Jun. 11, 2009

Related U.S. Application Data

(60) Provisional application No. 60/988,188, filed on Nov. 15, 2007.

(51) Int. Cl.
*E21B 29/12* (2006.01)

(52) U.S. Cl. ..... 166/367; 166/339; 166/349; 166/350

(58) Field of Classification Search ..... 166/350–355, 166/382, 96.1

See application file for complete search history.

(56) References Cited

U.S. PATENT DOCUMENTS 3,601,075 A * 8/1971 Deslierres ..... 114/293
4,194,568 A * 3/1980 Buresi et al. ..... 166/340
4,395,160 A * 7/1983 deJong ..... 405/224.4
4,401,164 A * 8/1983 Baugh ..... 166/379
4,423,982 A * 1/1984 Zaremba ..... 405/224.2
4,456,063 A * 6/1984 Roche ..... 166/84.4
4,657,439 A * 4/1987 Petersen ..... 405/200
4,883,387 A 11/1989 Myers et al.
4,913,238 A * 4/1990 Danazcko et al. ..... 405/223.1
4,913,592 A * 4/1990 Petty et al. ..... 405/223.1
4,934,870 A * 6/1990 Petty et al. ..... 405/199
5,615,977 A * 4/1997 Moses et al. ..... 405/195.1
6,045,296 A 4/2000 Otten et al.
6,139,224 A * 10/2000 Michel et al. ..... 405/224
6,260,625 B1 7/2001 Phan et al.
6,347,912 B1 * 2/2002 Thomas ..... 405/224.2
6,375,391 B1 * 4/2002 Børseth et al. ..... 405/224.4
6,470,969 B1 10/2002 Sorhaug et al.
6,644,409 B1 * 11/2003 Strømberg et al. ..... 166/349
6,712,560 B1 * 3/2004 Cottrell ..... 405/224.4
6,886,637 B2 * 5/2005 Hervey et al. ..... 166/355
6,986,227 B1 * 1/2006 Gavin ..... 52/20
7,096,958 B2 * 8/2006 Karayaka et al. ..... 166/367
7,377,325 B2 * 5/2008 Trinder et al. ..... 166/382
7,621,698 B2 * 11/2009 Pallini et al. ..... 405/223.1
2003/0102134 A1 * 6/2003 Reynolds ..... 166/379
2004/0156684 A1 * 8/2004 Pionetti ..... 405/224.2
2005/0147473 A1 7/2005 Pallini et al.
2005/0263288 A1 12/2005 Moe
2008/0166186 A1 7/2008 Pallini et al.
(Continued)

FOREIGN PATENT DOCUMENTS

WO WO93/19280 9/1993

*Primary Examiner* — Thomas Beach
*Assistant Examiner* — Aaron Lembo
(74) *Attorney, Agent, or Firm* — Bracewell & Giuliani LLP

(57) ABSTRACT

A tensioner anti-rotation device and method that transfers rotational force from an offshore platform deck to a riser in response to waves and currents. The device includes a bracket mounted on the deck, and a rib that transfers force from the deck through the bracket, to the rib, and into the riser such that the tensioners on the riser are not subjected to torque.

4 Claims, 5 Drawing Sheets

U.S. PATENT DOCUMENTS

2008/0304916 A1* 12/2008 Crotwell et al. ..... 405/224.2
2009/0092448 A1* 4/2009 Pallini et al. ..... 405/224
2010/0181064 A1* 7/2010 Knobloch et al. ..... 166/99
2011/0011320 A1* 1/2011 Yemington ..... 114/122

* cited by examiner

TENSIONER ANTI-ROTATION DEVICE

This application claims priority from the provisional application Ser. No. 60/988,188 filed Nov. 15, 2007 entitled "Tensioner Anti-Rotation Device," which is incorporated by reference herein in its entirety.

BACKGROUND

1. Field of Invention

This invention relates in general to devices for tensioning risers for offshore well production, and in particular to a device that causes the upper portion of the riser to rotate along with the vessel if the vessel rotates due to waves and currents.

2. Description of Related Art

Offshore production platforms must support production risers from oil or gas wells which extend to the platform from subsea wells. For platforms that are fixed to the ocean floor this is readily accomplished and is well known in the art. However, for subsea completions in deep water that require the use of floating platforms, such as tension leg platforms or semi-submersible platforms, supporting risers present significant problems. These platforms move under the influence of waves, wind, and current and are subjected to various forces, including rotational forces. Thus, the riser tensioning mechanism must permit the platform to move relative to the riser and care must be taken that the tensioning mechanism can withstand rotational forces.

The riser tensioning mechanism must also maintain the riser in tension so that the entire weight of the riser is not transferred to the wellhead and so that the riser does not collapse under its own weight. The tensioning mechanism must therefore exert a continuous tensional force on the riser. Also, this force must be maintained within a narrow tolerance. The use of a hydraulic cylinders attached between a platform and a riser to support the weight of the riser is well known in the art. The tensioner cylinders of the prior art are exposed to torque resulting from vessel rotation in response to environmental forces such as waves, currents, and wind. Improvements to protect the tensioner cylinder from this torque are desired.

SUMMARY OF INVENTION

The present invention disclosure comprises a tensioner anti-rotation device and method for transferring rotational force from the deck of a floating platform to a riser, thereby protecting tensioner cylinders from torque produced by vessel rotation in response to environmental forces such as waves, currents, and wind.

The apparatus comprises a key adapted to be mounted either to the riser or the deck; with a slot adapted to be located on the other of the riser or the deck, in vertical sliding engagement with the slot. The apparatus preferably includes two brackets mounted on the vessel's deck. Each bracket can have either a key or a slot on its inner side and is preferably located 180° apart from the other. Each bracket is in proximity to the riser and tensioner cylinders. An axially extending key or slot is located on the riser, or on an attached sleeve. The key and slot arrangement between the riser and deck-mounted bracket loosely engage, allowing axial movement of the arrangement with respect to the riser. The system allows for axial movement that is greater than the stroke length of the tensioner cylinders.

Where the key comprises a rib adapted to be mounted to the riser, the rib has a greater longitudinal length than slot. However, if the slot is adapted to be located on the riser, the slot then has a greater longitudinal length than the key.

When the vessel rotates, the key and slot arrangement on the riser and bracket engage, with the key contacting the inner portion of the slot. The contact between the key and slot transfers the torque from the deck, the bracket, through the key and slot arrangement, and to the riser. The tensioner cylinders are thus protected from torque that could disturb their alignment or result in damage.

The apparatus could also include a guide roller adapted to engage riser in lieu of brackets. The guide roller is mounted to the deck and has a slot, with a key adapted to be mounted to the riser.

BRIEF DESCRIPTION OF DRAWINGS

Some of the features and benefits of the present invention having been stated, others will become apparent as the description proceeds when taken in conjunction with the accompanying drawings, in which.

DETAILED DESCRIPTION OF INVENTION

Figure 1:
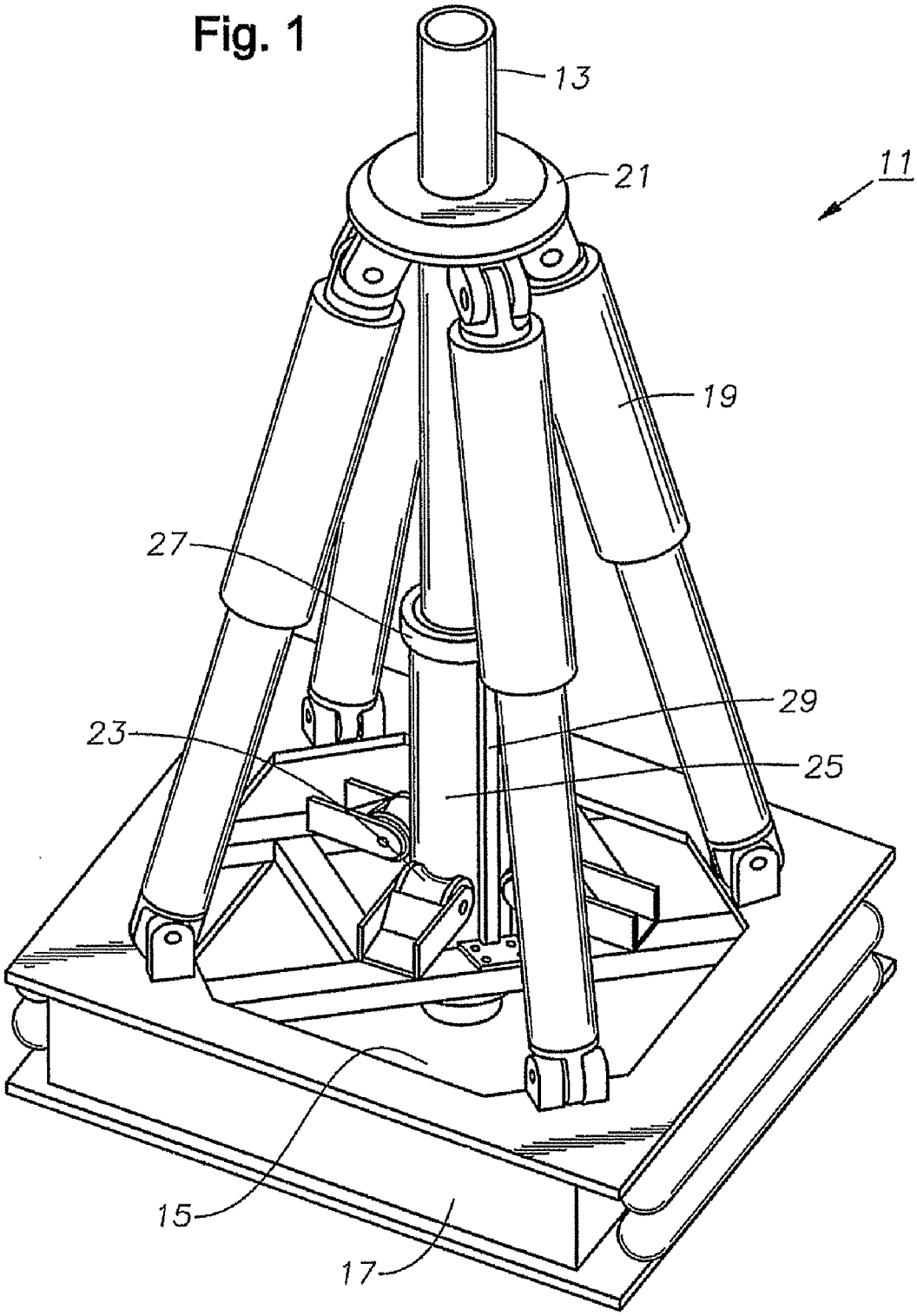
FIG. 1 is a perspective view illustrating a riser tensioner constructed in accordance with this invention

Referring to FIG. 1, riser tensioner assembly 11 provides tension to a riser 13 that has its lower end secured to subsea equipment such as a subsea wellhead assembly (not shown). Riser 13 extends upward through an opening 15 in a deck 17 of the vessel. Although moored, typically the vessel will move relative to riser 13 in response to current and wave motion. A plurality of cylinder assemblies 19 are supplied with hydraulic fluid and gas under pressure to provide an upward force to riser 13 to maintain a uniform tension in riser 13 as deck 17 moves relative to riser 13. Cylinder assemblies 19 are conventional, each having a piston and piston rod. A lower end of each cylinder assembly 19 is mounted to deck 17 and an upper end is mounted to a clamp assembly 21, which clamps to riser 13. A plurality of guide rollers 23 may be employed to centralize riser 13. Guide rollers 23 are mounted circumferentially around riser 13 for rolling engagement with riser 13, or a component mounted to riser 13.

In this embodiment, a cylindrical sleeve 25 is mounted around riser 13. Sleeve 25 is rigidly attached to and surrounds an inner cylinder of the riser 13 so that it will not move axially or rotationally relative to riser 13 and thus may be considered as part of the riser 13. Sleeve 25 has a length greater than the maximum stroke of cylinder assemblies 19 from the contracted to the extended positions so that rollers 23 remain in engagement with sleeve 25.

In this example, sleeve 25 has an inner diameter larger than an outer diameter of riser 13, defining an annular clearance between them. Sleeve has a flange 27 at its upper and lower ends that extends radially outward. An axially extending key or rib 29 is mounted on the exterior of sleeve 25 and extends from the lower flange 27 (FIG. 2) to the upper flange 27. Rib 29 may be attached either by welding or fasteners. Rib 29 may have a rectangular or other configuration in cross-section.

Figure 3:
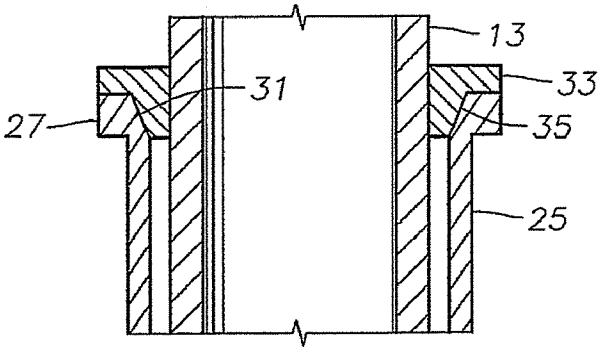
FIG. 3 is a sectional view of a portion of the riser of FIG. 2, illustrating the attachment of a sleeve.

Sleeve 25 may be secured to riser 13 in a variety of manners so as to be rigidly attached. In this embodiment, as shown in FIG. 3, flange 27 has a tapered inner diameter 31. A split bushing 33 has a tapered surface 35 that faces outward and mates with tapered surface 31. Split bushing 33 is placed around riser 13 then clamped tightly to flange 27, such as by fasteners. Split bushing 33 has an inner diameter slightly smaller than the outer diameter of riser 13 so that when secured to flange 27, it wedges sleeve 25 into tight engagement with riser 13. A similar arrangement for securing sleeve 25 will be located on the lower flange 27.

Figure 4:
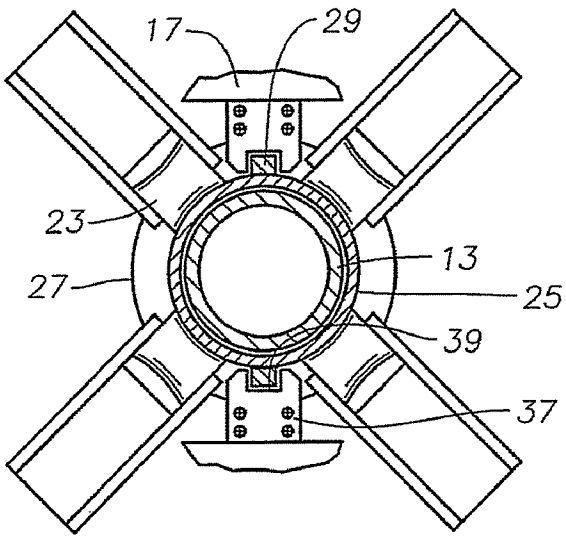
FIG. 4 is a sectional view of the riser tensioner of FIG. 2, taken along the line 4-4 of FIG. 2.

Referring to FIG. 4, a bracket 37 is mounted to deck 17 (shown schematically) for each rib 29. In the embodiment of FIG. 4, there are two keys or ribs 29, each located 180° apart from the other; however, fewer or more ribs 29 could be employed. Each bracket 37 has a slot 39 on its inner side that fits loosely around three sides of one of the ribs 29. As deck 17 moves upward and downward relative to riser 13, brackets 37 will slide up and down ribs 29. If a rotational force occurs, such as from current or yawing of the vessel, this rotational force is transferred from deck 17 through brackets 37, ribs 29, sleeve 25 and to riser 13. The upper portion of riser 13 will rotate with the vessel. The engagement between brackets 37 and ribs 29 causes the upper portion of riser 13 to twist or rotate in unison with deck 17. This arrangement avoids a twisting force or torque being transferred through cylinder assemblies 19.

Figure 6:
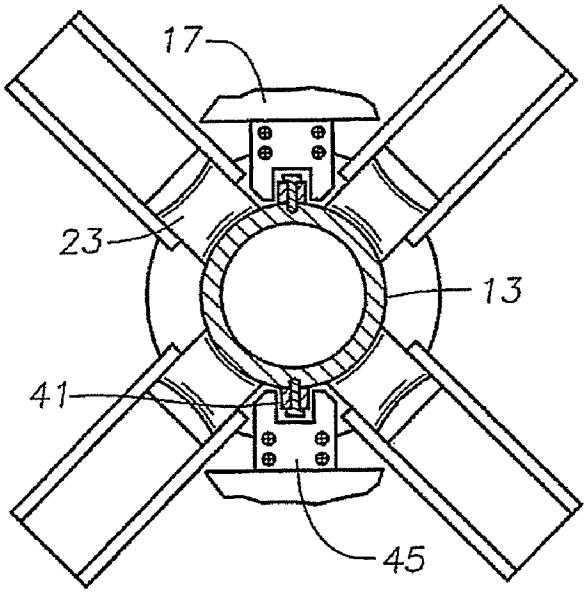
FIG. 6 is a sectional view of the riser tensioner of FIG. 5, taken along the line 6-6 of FIG. 5.
Figure 5:
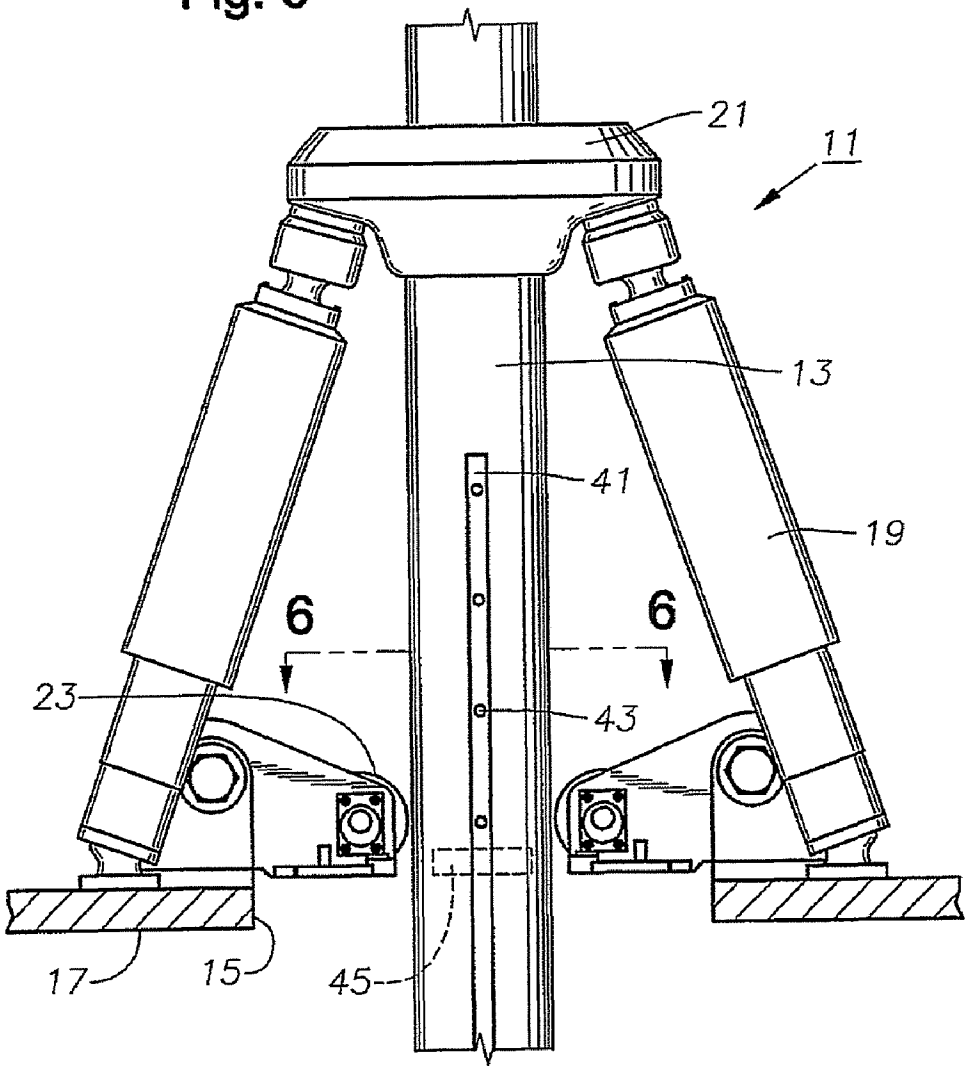
FIG. 5 is a side elevational view of an alternate embodiment of the riser tensioner constructed in accordance with this invention.

Other devices may be employed to cause riser 13 to twist if the vessel rotates. For example, the embodiment in FIGS. 5 and 6 does not employ a sleeve 25. Rather, key or rib 41 is attached directly to riser 13, such as by cap screws 43. As shown in FIG. 6, brackets 45 may be identical to brackets 37 of FIG. 4. Brackets 45 have slots that receive ribs 41.

Figure 2:
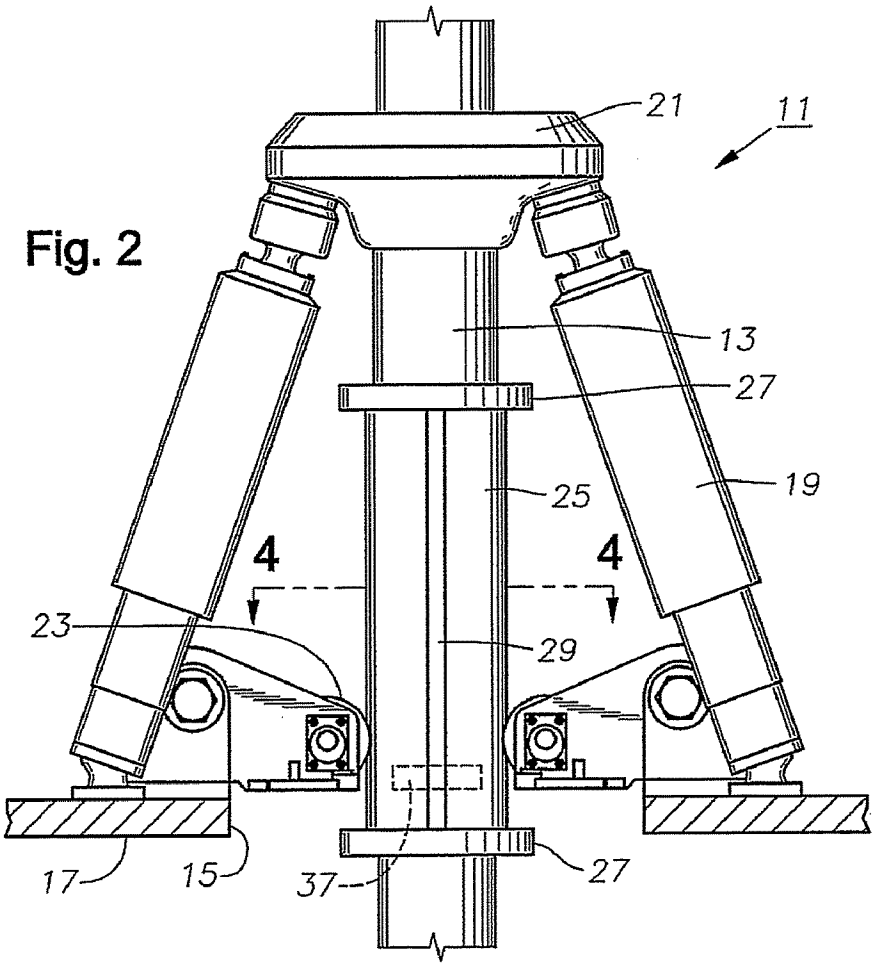
FIG. 2 is a side elevational view of the riser tensioner of FIG. 1.
Figure 8:
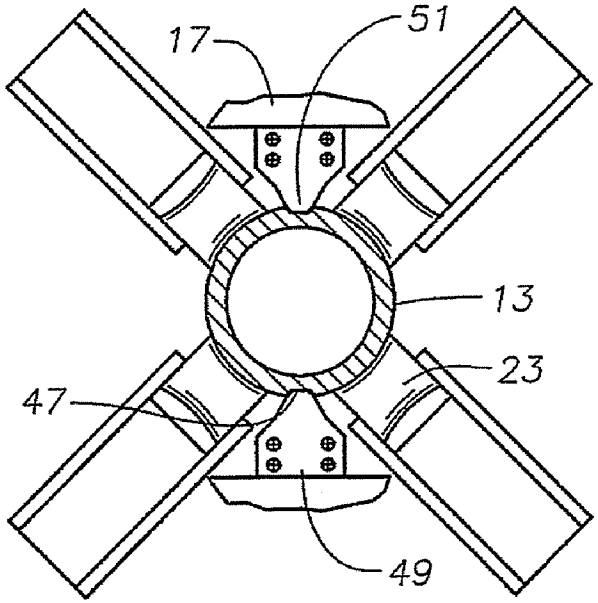
FIG. 8 is a sectional view of the riser tensioner of FIG. 7, taken along the line 8-8 of FIG. 7.
Figure 7:
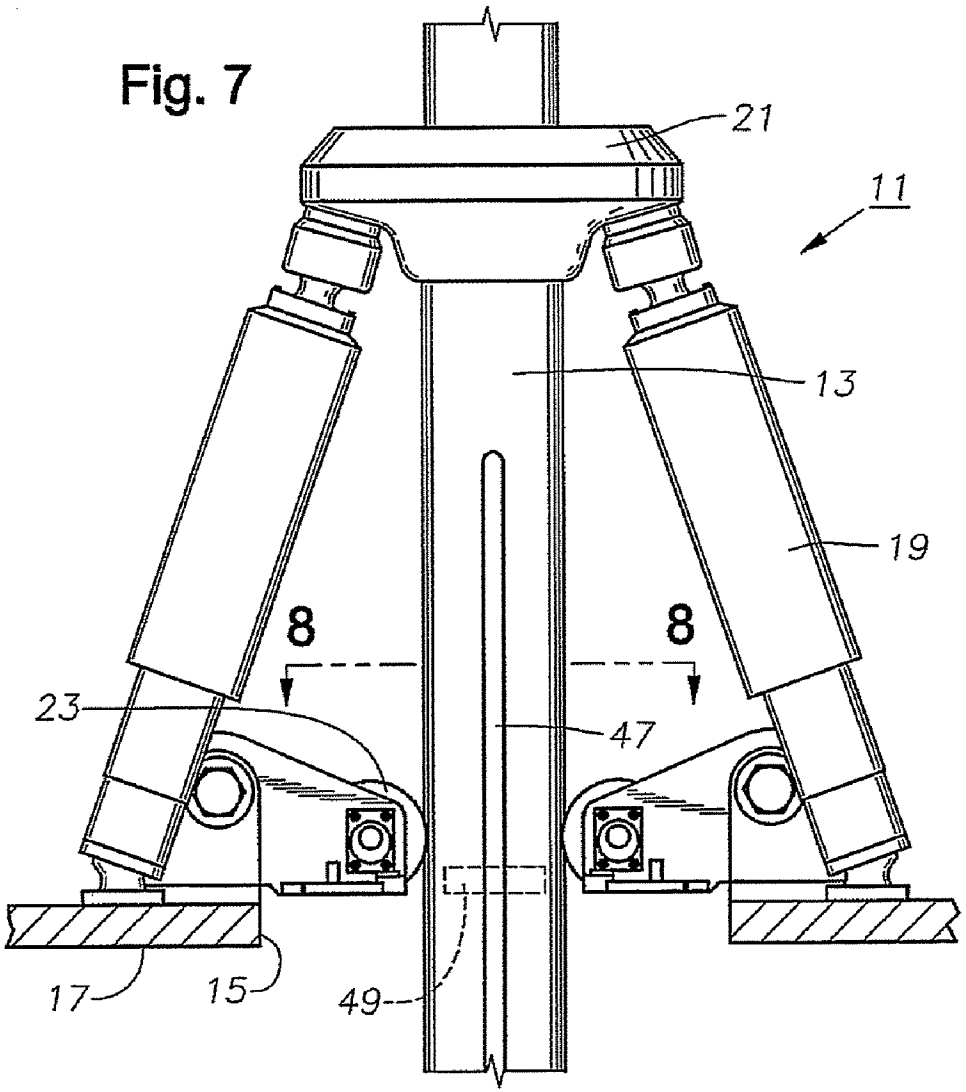
FIG. 7 is a side elevational view of another embodiment of a riser tensioner constructed in accordance with this invention.

In FIG. 7, rather than a key or rib, a slot 47 is formed, and in this example, slot 47 is formed directly in riser 13, although it could be formed within a sleeve. Slot 47 extends axially along riser 13 in the same manner as ribs 41 (FIG. 5) and ribs 29 (FIG. 2). As shown in FIG. 8, brackets 49 are mounted to deck 17. Each bracket 49 has a key or tongue 51 that locates within one of the slots 47. Tongue 51 is able to slide up and down within slot 47, and will transmit any rotational force from deck 17 to riser 13. Rollers 23 engage riser 13. Alternatively, one or more rollers having a central rib that is inserted into slot 47 may be used.

Figure 10:
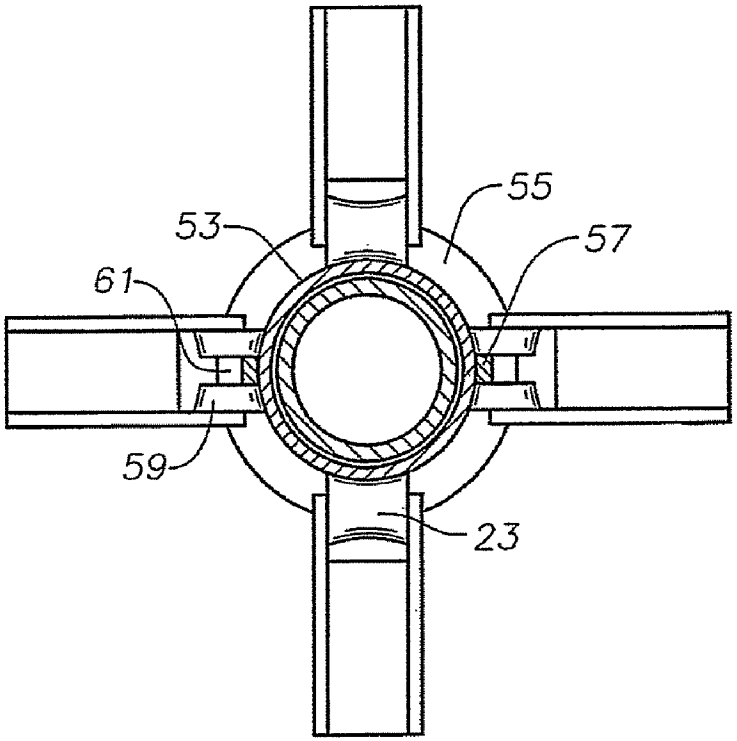
FIG. 10 is a sectional view of the riser tensioner of FIG. 9, taken along the line 10-10 of FIG. 9.
Figure 9:
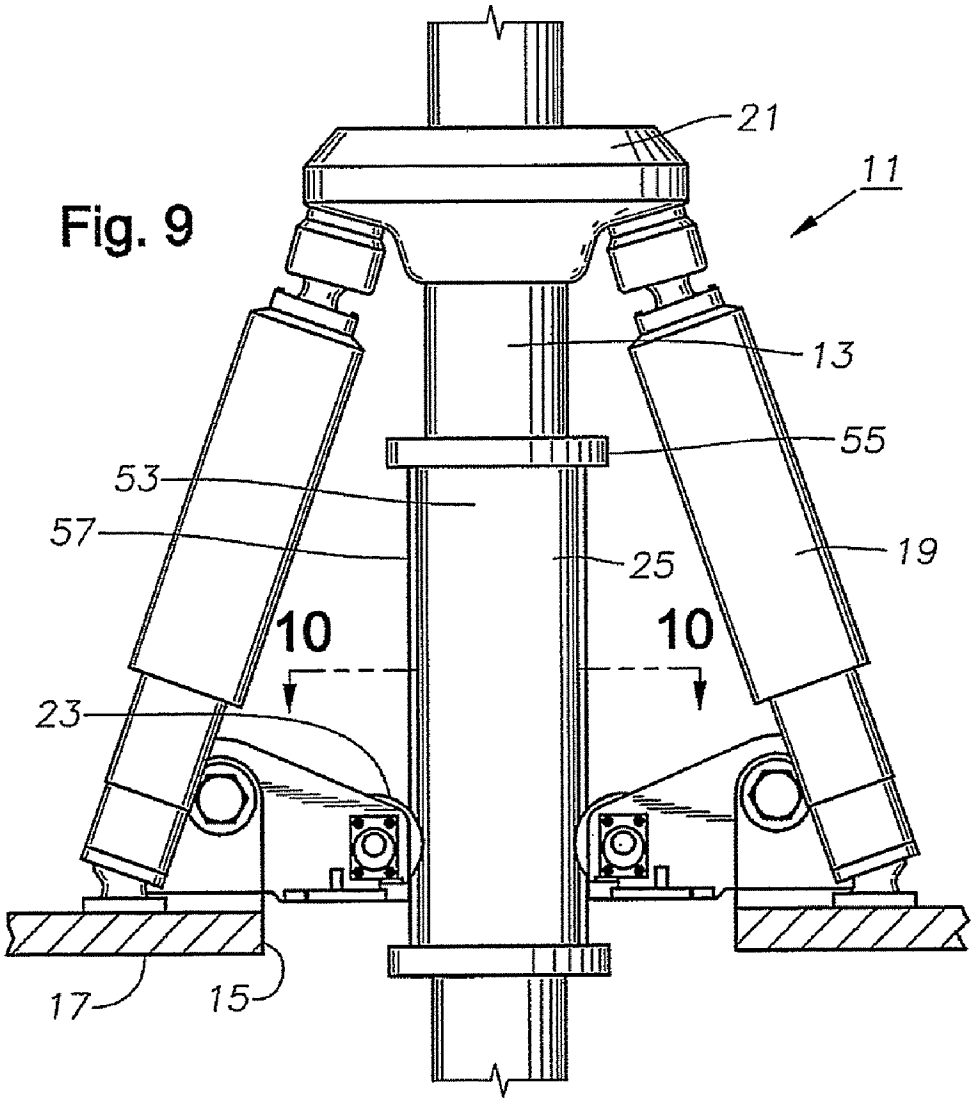
FIG. 9 is a side elevational view of still another alternate embodiment of a riser tensioner in accordance with this invention.

Referring to FIG. 9, in this embodiment, a sleeve 53 is rigidly attached to riser 13. Sleeve 53 may be attached by flanges 55 and a split bushing (not shown) in the same manner as sleeve 25 of FIG. 2. Keys or ribs 57 are secured to the outer diameter of sleeve 53, either by welding or fasteners. As shown in FIG. 10, in this embodiment, there are two ribs 57, each spaced 180° apart. Rather than a separate bracket, such as bracket 37 (FIG. 4) or bracket 45 (FIG. 6), each rib 57 is engaged by a central portion 61 of one of the rollers 59. In this example, two of the rollers 59 have one of the central portions 61, each central portion 61 being of smaller diameter than the outer end portions. The outer end portions engage the outer diameter of sleeve 53. Each central portion 61 engages one of the ribs 57 to transfer any torque imposed by rotational movement of the vessel through rollers 59 into riser 13.

This written description uses examples to disclose the invention, including the best mode, and also to enable any person skilled in the art to practice the invention, including making and using any devices or systems and performing any incorporated methods. These embodiments are not intended to limit the scope of the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A tensioner anti-rotation device for transferring rotational force from deck of a floating platform to a riser, the tensioner anti-rotation device comprising:

a first member adapted to be secured to the riser;

a second member adapted to be secured to the floating platform, wherein the second member blocks rotational movement of the first member relative to the second member and enables movement of the first member relative to the second member along an axis of the riser;

wherein one of the first member or the second member comprises a key and one of the second member or the first member comprises a slot adapted for the vertical sliding engagement with the key; and wherein the key comprises a protuberance on a bracket adapted to be mounted to the deck.

2. In an offshore well installation having a riser extending upward from a subsea well, a floating platform having an opening through which the riser extends, a riser tensioner mounted to the platform at the opening for applying tension to the riser, and a set of guide rollers mounted to the platform at the opening and in engagement with the riser, the improvement comprising:

a key and a slot arrangement mounted between the riser and the platform for inhibiting rotation of the platform relative to the riser; and wherein the key comprises a protuberance on a bracket mounted to a deck of the floating platform.

3. In an offshore well installation having a riser extending upward from a subsea well, a floating platform having an opening through which the riser extends, a riser tensioner mounted to the platform at the opening for applying in engagement with the riser, the improvement comprising:

a key and a slot arrangement mounted between the riser and the platform for inhibiting rotation of the platform relative to the riser; wherein the riser further comprises:

a cylindrical sleeve rigidly attached to and surrounding an inner cylinder of the riser;

a flange at upper end of the sleeve;

a flange at lower end of the sleeve; and wherein the key is mounted to the sleeve and the slot is mounted to a deck of the floating platform.

4. A method for applying tension to a riser, the method comprising:

securing a first end of a tensioner cylinder assembly to a riser and a second end of the tensioner cylinder assembly to a floating platform to enable the tensioner cylinder assemblies to place the riser in axial tension;

coupling the riser to the floating platform to prevent rotational movement of the first end of the tensioner cylinder assembly relative to the second end of the tensioner cylinder assembly; and wherein coupling the riser to the floating platform comprises securing a key to a deck of the floating platform and securing a slot to the riser, the key and the slot being configured for vertical sliding engagement.

* * * * *